US010605564B2

(12) United States Patent
Kokoruda et al.

(10) Patent No.: US 10,605,564 B2
(45) **Date of Patent: *Mar. 31, 2020**

(54) STORAGE CASE WITH PULL HANDLE FOR GUN CLEANING TOOL

(71) Applicant: BUSHNELL INC., Overland Park, KS (US)

(72) Inventors: Laurie A. Kokoruda, Bonner Springs, KS (US); Jason L. Slinkard, Blue Springs, MO (US)

(73) Assignee: Bushnell Inc., Overland Park, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/268,773

(22) Filed: Feb. 6, 2019

(65) Prior Publication Data

US 2019/0170478 A1 Jun. 6, 2019

Related U.S. Application Data

(63) Continuation of application No. 15/650,551, filed on Jul. 14, 2017, now Pat. No. 10,240,895.

(51) Int. Cl.

| | |
|---|---|
| ***F41C 33/06*** | (2006.01) |
| ***B65D 50/04*** | (2006.01) |
| ***F41A 29/00*** | (2006.01) |
| ***F41A 29/02*** | (2006.01) |
| *F41A 35/00* | (2006.01) |
| *F41C 27/00* | (2006.01) |
| *F41C 33/00* | (2006.01) |

(52) U.S. Cl.

CPC ..... *F41C 33/06* (2013.01); *B65D 50/04* (2013.01); *F41A 29/00* (2013.01); *F41A 29/02* (2013.01); *F41A 35/00* (2013.01); *F41C 27/00* (2013.01); *F41C 33/00* (2013.01)

(58) Field of Classification Search

CPC ..... B65D 50/04; F41C 33/00; F41C 33/06; F41A 29/00; B08B 9/02; B08B 9/027

USPC ..... 206/374, 375; 220/787, 666; 15/104.03, 15/104.05; 45/95; 16/110.1

See application file for complete search history.

(56) References Cited

U.S. PATENT DOCUMENTS

| | | | | |
|---|---|---|---|---|
| 5,743,040 | A * | 4/1998 | Kennedy | F41A 29/02 42/95 |
| 5,946,843 | A * | 9/1999 | Paananen | F41A 29/00 42/95 |
| 10,240,895 | B2 * | 3/2019 | Kokoruda | F41C 33/06 |

(Continued)

*Primary Examiner* — Rafael A Ortiz

(74) *Attorney, Agent, or Firm* — Walter M. Egbert, III; Gerard M. Donovan; Reed Smith LLP

(57) ABSTRACT

A gun cleaning apparatus includes a cleaning tool and a storage case. The cleaning tool has a cleaning section and a pull cord having a distal end for pulling the cleaning section through a gun barrel. The storage case is configured for enclosing the cleaning tool. The storage case includes a substantially hollow container having an open top and a removable lid. The removable lid is selectively positionable between a closed configuration wherein it closes the open top, and an open configuration wherein it is free from the hollow container and serves as a pull handle for the cleaning tool. The removable lid includes a connection section for connecting to the distal end of the pull cord after the pull cord has been inserted through the gun barrel, and a handle section for gripping by a user to assist with pulling the cleaning tool through the gun barrel.

20 Claims, 10 Drawing Sheets

(56) References Cited

U.S. PATENT DOCUMENTS

| | | | | |
|---|---|---|---|---|
| 2013/0199072 | A1* | 8/2013 | Richter | F41A 29/00<br>42/95 |
| 2016/0377374 | A1* | 12/2016 | Pikielny | F41C 33/06<br>206/216 |

* cited by examiner

STORAGE CASE WITH PULL HANDLE FOR GUN CLEANING TOOL

CROSS-REFERENCE TO RELATED APPLICATION DATA

This application is a continuation of U.S. patent application Ser. No. 15/650,551 filed on Jul. 14, 2017, which is incorporated herein its entirety.

BACKGROUND

The field of the disclosure relates generally to storages cases, and more particularly, to storage cases with pull handles for gun cleaning tools for cleaning the inside of gun barrels.

At least some known gun cleaning devices for cleaning the inside of gun barrels include a cord coupled to a tubular sheath that encases a brush with bristles that protrude through the tubular sheath. The gun barrel may be cleaned by threading the cord through the gun barrel and pulling the cord through the barrel such that the tubular sheath and the brush travel through the barrel as well. The tubular sheath may be of a larger diameter than the cord and may not enter the barrel smoothly or easily. For example, the brush applies a scrubbing force to the inner surface of the gun barrel and typically encounters friction and resistance when being pulled through the gun barrel. As such, the cleaning tool may be difficult to pull through the gun barrel. At least some known cleaning devices include a loop of material integrated into the tubular sheath to facilitate pulling the cleaning tool out of the gun barrel.

Pulling the gun cleaning tool through the gun barrel causes the bristles to scrub and loosen debris from the barrel. At least some known cleaning devices include a cleaning element that trails the bristles and facilitates capturing and removing the dirt, debris, and other particulates from the gun barrel as the tubular sheath of the cleaning tool is pulled along the gun barrel. As such, the gun cleaning tool typically becomes dirty and may transfer the dirt, debris, and other particulates to a user's hands and clothes if not disposed of properly.

BRIEF DESCRIPTION OF THE INVENTION

Embodiments of the present invention solve the above-mentioned problems and other problems by providing ways to store and handle a gun cleaning tool. In one aspect, a gun cleaning apparatus is provided. The gun cleaning apparatus includes a cleaning tool having a cleaning section and a pull cord. The pull cord includes a proximal end coupled to the cleaning section and a distal end for pulling the cleaning section through a gun barrel. The gun cleaning apparatus also includes a storage case for enclosing the cleaning tool both before and after use. The storage case includes a substantially hollow container having an open top and a removable lid configured to couple to the hollow container. The removable lid is selectively positionable between a closed configuration wherein the removable lid closes the open top, and an open configuration wherein the removable lid is free from the hollow container and serves as a pull handle for the cleaning tool. The removable lid also serves as a pull handle for the cleaning tool and includes a connection section for connecting to the distal end of the pull cord after the pull cord has been inserted through the gun barrel, and a handle section for gripping by a user to assist with pulling the cleaning tool through the gun barrel. In some embodiments, the storage case may be provided without the cleaning tool.

In another aspect, a method of cleaning a gun barrel using a gun cleaning apparatus, such as the gun cleaning apparatus described above, is provided. The method includes removing a removable lid from the storage case. The removable lid includes a connection section for connecting to the cleaning tool after the cleaning tool has been inserted through the gun barrel, and a handle section for gripping by a user to assist with pulling the cleaning tool through the gun barrel. The method also includes coupling the cleaning tool to the connection section of the removable lid. Moreover, the method includes pulling on the handle section of the removable lid to channel the cleaning tool through the gun barrel.

This summary is provided to introduce a selection of concepts in a simplified form that are further described in the detailed description below. This summary is not intended to identify key features or essential features of the claimed subject matter, nor is it intended to be used to limit the scope of the claimed subject matter. Other aspects and advantages of the present invention will be apparent from the following detailed description of the embodiments and the accompanying drawing figures.

DRAWINGS

These and other features, aspects, and advantages of the present disclosure will become better understood when the following detailed description is read with reference to the accompanying drawings in which like characters represent like parts throughout the drawings, wherein.

Figure 2:
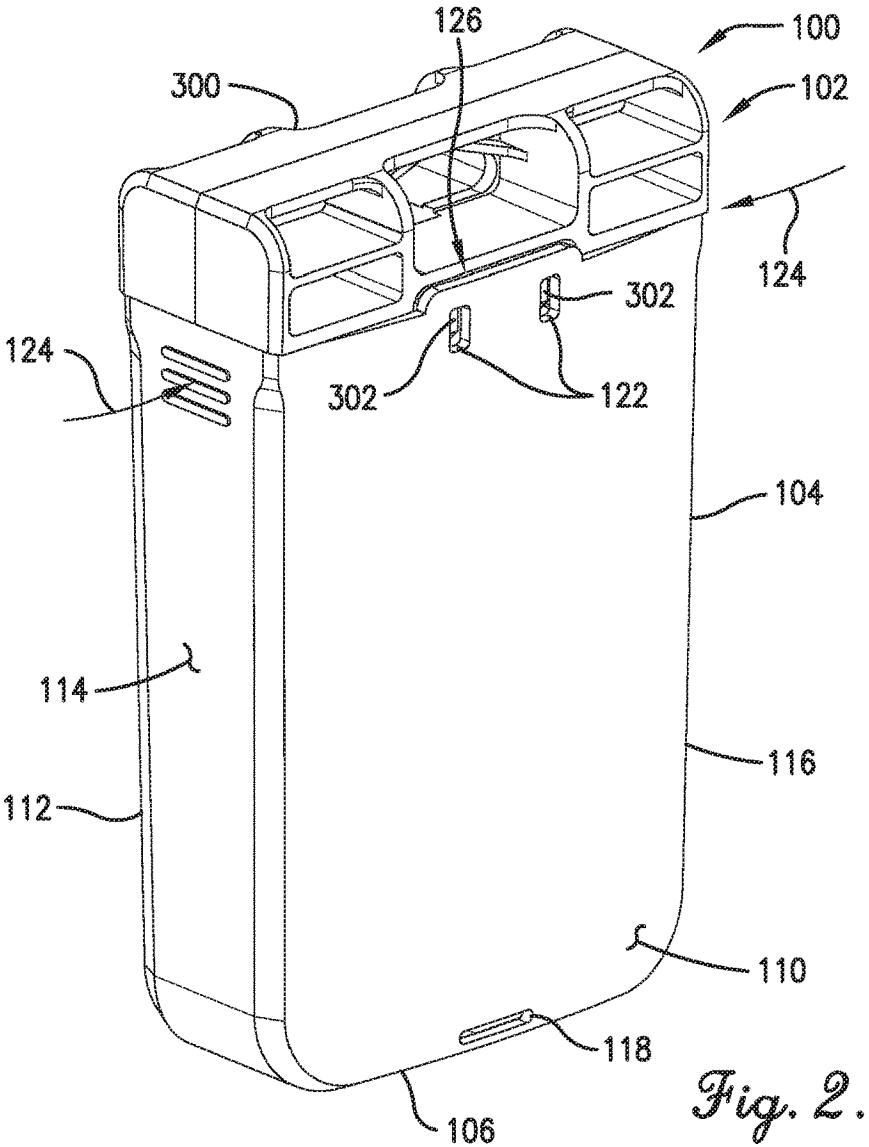
FIG. 2 is a perspective view of the gun cleaning apparatus of FIG. 1, and showing walls of a container bowing outward.

Unless otherwise indicated, the drawings provided herein are meant to illustrate features of embodiments of this disclosure. These features are believed to be applicable in a wide variety of systems comprising one or more embodiments of this disclosure. As such, the drawings are not meant to include all conventional features known by those of ordinary skill in the art to be required for the practice of the embodiments disclosed herein. The drawings are not necessarily to scale, emphasis instead being placed upon clearly illustrating the principles of the embodiments of this disclosure.

DETAILED DESCRIPTION

The following detailed description of embodiments of the disclosure references the accompanying drawings. The embodiments are intended to describe aspects of the disclosure in sufficient detail to enable those skilled in the art to practice the disclosure. Other embodiments can be utilized and changes can be made without departing from the scope of the claims. The following detailed description is, therefore, not to be taken in a limiting sense. The scope of the present disclosure is defined only by the appended claims, along with the full scope of equivalents to which such claims are entitled.

In this description, references to "one embodiment," "an embodiment," or "embodiments" mean that the feature or features being referred to are included in at least one embodiment of the technology. Separate references to "one embodiment," "an embodiment," or "embodiments" in this description do not necessarily refer to the same embodiment and are also not mutually exclusive unless so stated and/or except as will be clear to those skilled in the art from the description. For example, a feature, structure, act, etc. described in one embodiment may also be included in other embodiments, but is not necessarily included. Thus, the present technology can include a variety of combinations and/or integrations of the embodiments described herein.

In the following specification and the claims, reference will be made to several terms, which shall be defined to have the following meanings. The singular forms "a," "an," and "the" include plural references unless the context clearly dictates otherwise. "Optional" or "optionally" means that the subsequently described event or circumstance may or may not occur, and that the description includes instances where the event occurs and instances where it does not.

Approximating language, as used herein throughout the specification and the claims, may be applied to modify any quantitative representation that could permissibly vary without resulting in a change in the basic function to which it is related. Accordingly, a value modified by a term or terms, such as "about," "approximately," and "substantially" are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

Figure 1:
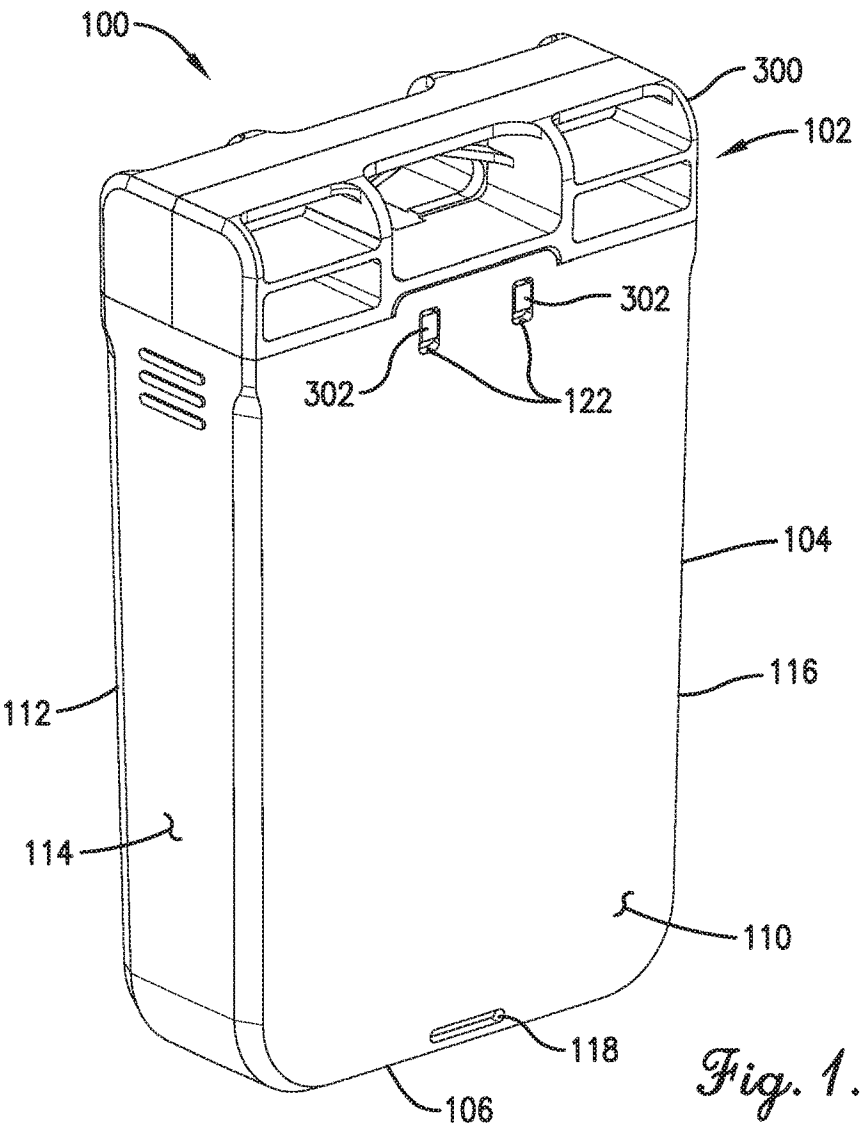
FIG. 1 is a perspective view of an exemplary gun cleaning apparatus constructed in accordance with embodiments of the present invention.
Figure 3:
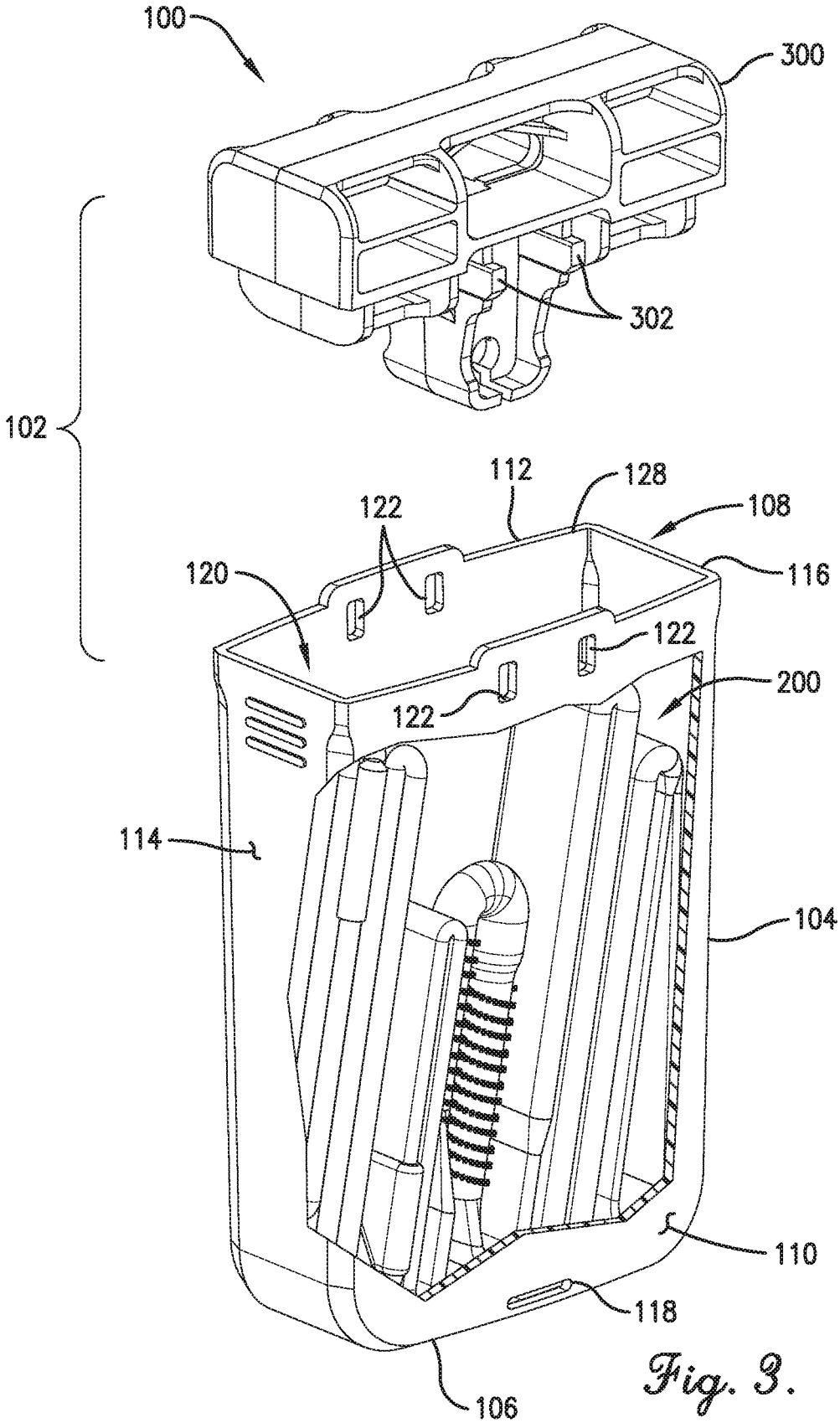
FIG. 3 is an exploded cutaway perspective view of the gun cleaning apparatus of FIG. 1, and showing a cleaning tool contained in the container.

Referring now to the drawings and in particular FIGS. 1-3, a gun cleaning apparatus is generally indicated at 100. The gun cleaning apparatus 100 includes a storage case 102 for holding at least one cleaning tool 200. The storage case 102 includes an enclosure or container 104 and a removable lid 300 (broadly, a closure). Each of the container 104, the cleaning tool 200, and the removable lid 300 are indicated generally by their respective reference number.

The container 104 has a closed bottom wall 106, an open top 108, and a plurality of walls, including a front wall 110, an opposite rear wall 112, and side walls 114 and 116. The front wall 110, rear wall 112, and side walls 114 and 116, are coupled together and extend between the closed bottom wall 106 and the open top 108 to form a substantially hollow container 104. One of the front wall 110 and the rear wall 112 includes a vent 118 defined therethrough such that fluid, for example, and without limitation air and/or a liquid, can pass into and/or out of an interior space 120 of the container 104. It is contemplated the container 104 may include more than one vent 118, defined in any of the front wall 110, rear wall 112, and side walls 114 and 116. In some embodiments, the vent 118 may be omitted from the container 104.

In the exemplary embodiment, the removable lid 300 forms a closure for the container 104, thereby forming the storage case 102. The removable lid 300 is selectively positionable between a closed configuration, as is shown in FIG. 1, and an open configuration, as is shown in FIG. 3. In the exemplary embodiment, in the open configuration, the removable lid 300 is free from the container 104, i.e., there is no connection to the container 104 such as a strap, cord, or other flexible connection element. It is contemplated, however, that in some embodiments, the removable lid 300 may be coupled to the container 104 to facilitate retaining the removable lid 300 proximate to the container 104. This facilitates reducing the likelihood that the removable lid 300 and/or container 104 may become misplaced so as not to be able to close the container 104.

In the exemplary embodiment, the container 104 and the removable lid 300 are each fabricated from a polymeric or plastic material including, for example, polypropylene or polyethylene. The container 104 and the removable lid 300 are formed by a molding process, and accordingly, the features of the container 104 and the removable lid 300 described herein may have a draft angle associated with each wall and/or cavity to promote removal of the container 104 and the removable lid 300 from a mold. Furthermore, the container 104 and the removable lid 300 may be fabricated by methods other than molding, e.g., machining, and therefore, may not have a draft angle associated with the features as described herein. Moreover, the container 104 and the removable lid 300 may each be fabricated from any other suitable materials that enable the container 104 and the removable lid 300 to function as described herein, for example, without limitation, composite or metallic materials. It is also understood that the container 104 and the removable lid 300 can also be made in any desired color or colors, and may be transparent, translucent, or opaque. For example, and without limitation, in one embodiment, the container 104 is fabricated from a generally clear or translucent polypropylene material and the removable lid is fabricated from an opaque polypropylene material.

In the exemplary embodiment, the front wall 110 and the rear wall 112 include one or more latch apertures 122 located proximate the open top 108 of the container 104. In particular, and as best shown in FIG. 3, each of the front wall 110 and the rear wall 112 include an adjacent pair of substantially similar latch apertures 122 extending through the respective wall. The latch apertures 122 are illustrated as having a generally rectangular shape, although other shapes are contemplated. In some embodiments, the latch apertures 122 do not extend through the front wall 110 and the rear wall 112, but rather are notches defined on an inner surface of the respective front wall 110 and the rear wall 112.

In the exemplary embodiment, the removable lid 300 includes a plurality of latch hooks 302 extending outward from the removable lid 300. Each latch hook 302 is configured to engage a respective latch aperture 122 defined in one of the front wall 110 and the rear wall 112 when the removable lid 300 is in the closed configuration, as shown in FIG. 1. Lengths of the latch hook 302 extending outward from the removable lid 300 and a spacing of the latch apertures 122 below the open top 108 of the container 104 are configured such that the removable lid is securely held in place when in the closed configuration, but is easily released from the container to transition to the open configuration of FIG. 3. In the closed configuration, the removable lid 300 is securely held by latch hooks 302 engaging (e.g., extending into) respective latch apertures 122.

In the exemplary embodiment, the walls of the container 104, and in particular, the front wall 110 and the rear wall 112, are fabricated with a thickness that enables the front wall 110 and the rear wall 112 to flex or bow a predetermined amount to enable selectively positioning the removable lid 300 between the closed and open configurations. Generally, the front wall 110 and the rear wall 112 are substantially planar when the removable lid 300 is in the opened or closed configurations. As such, in the closed configuration, the latch hooks 302 extend into the latch apertures 122. The front wall 110 and the rear wall 112 can be flexed or bowed outwardly to disengage the latch hooks 302 from the latch apertures 122 by applying inwardly directed pressure to the adjoining side walls 114 and 116, as generally indicated by arrows 124 of FIG. 2.

In the closed configuration shown in FIG. 1, each of the latch hooks 302 is engaged in with a respective latch aperture 122, where the front wall 110 and the rear wall 112 are substantially planar. To open the storage case 102, the latch hooks 302 must be released. This is facilitated by squeezing, i.e., applying an inward force to the side walls 114 and 116, for example with the thumb and fingers of a user's hand. The inwardly directed force causes the front wall 110 (as well as the rear wall 112) to flex or bow outwardly, as indicated generally by arrow 126, disengaging latch hook 302 from latch apertures 122. With the latch hooks 302 thus released from the container 104, the removable lid 300 may be removed vertically from the container 104 to the opened configuration shown in FIG. 3. The storage case 102 is closed and latched by pushing the removable lid 300 back to its closed position. As described further herein, the latch hooks 302 are configured to flex or bow the front wall 110 and the rear wall 112 outward during closure of the storage case 102.

Figure 4:
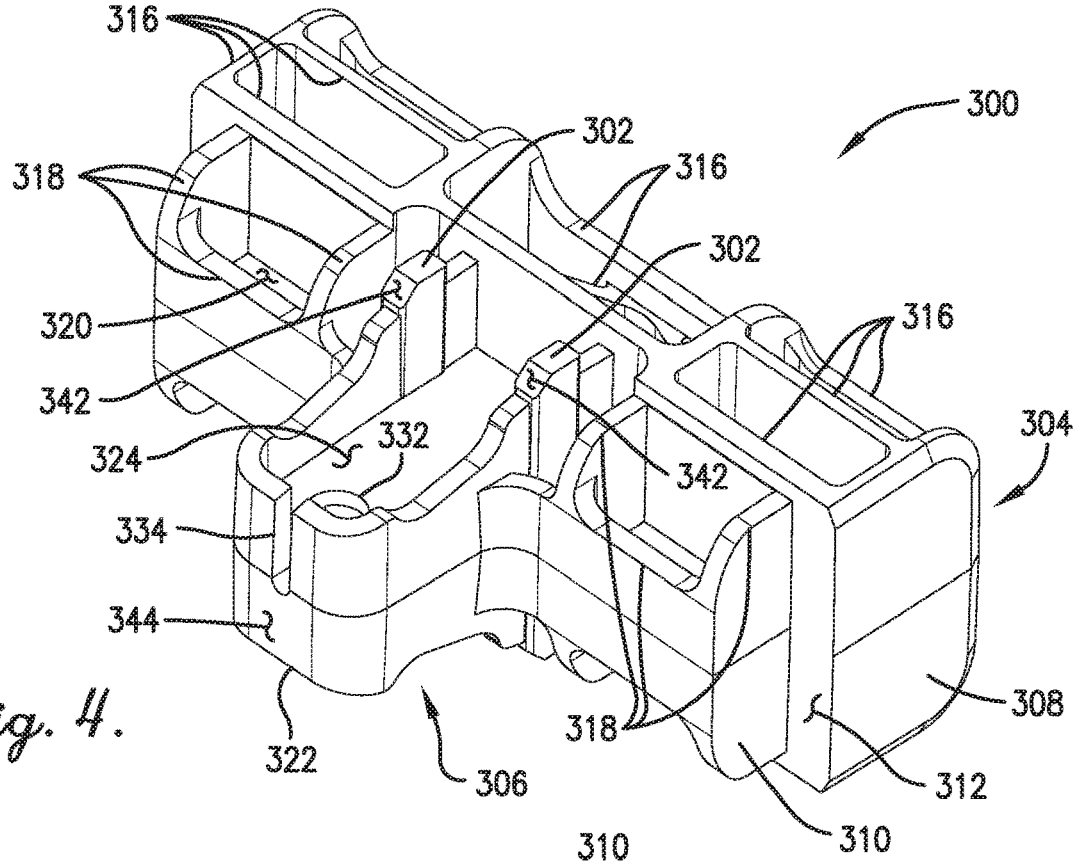
FIG. 4 is a perspective view of a removable lid of the gun cleaning apparatus of FIG. 1 as seen from the upper right and front sides of the removable lid.
Figure 5:
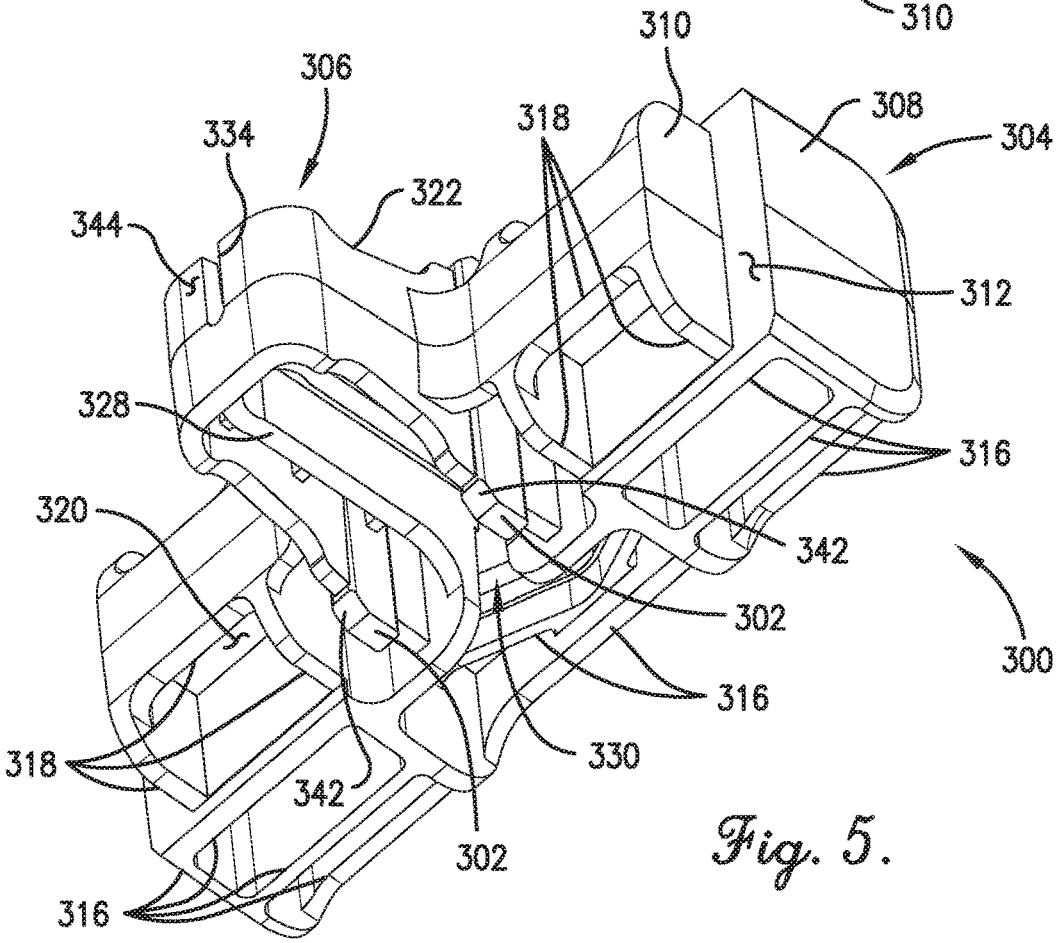
FIG. 5 is a perspective view of the removable lid of FIG. 4 as seen from the lower right and front sides of the removable lid.
Figure 6:
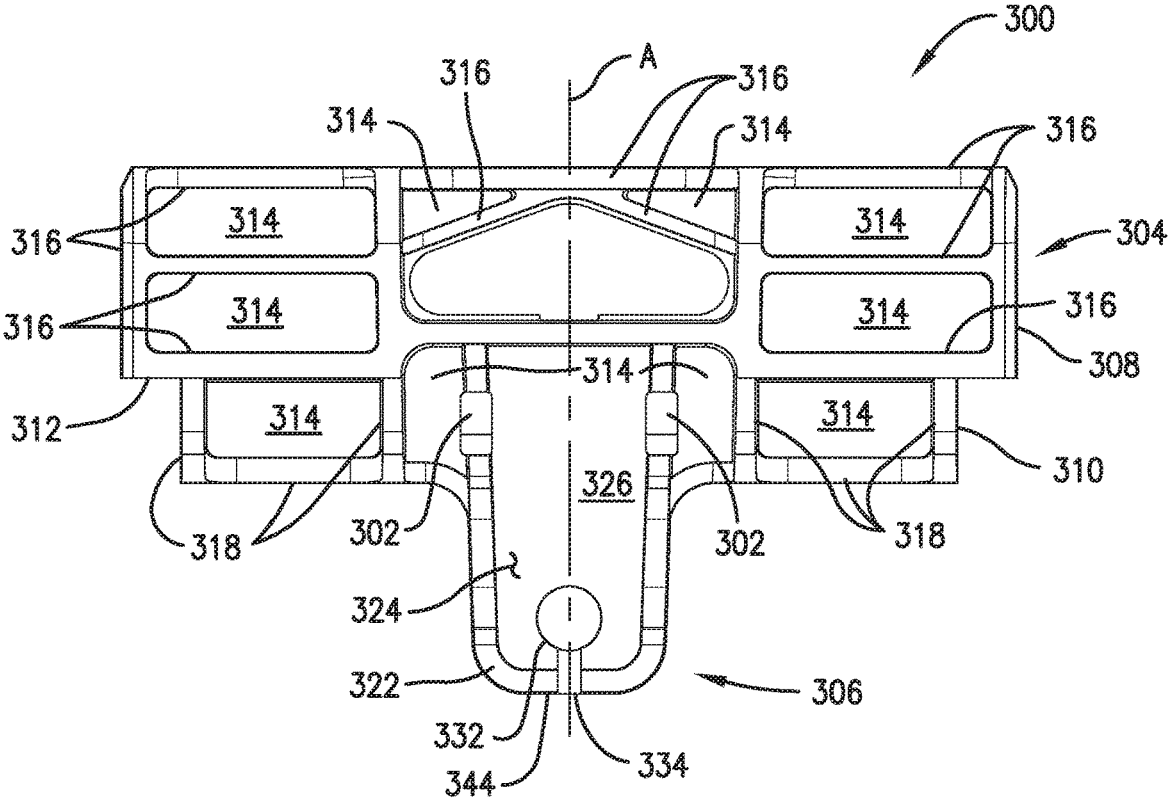
FIG. 6 is a top view of the removable lid of FIG. 4.
Figure 7:
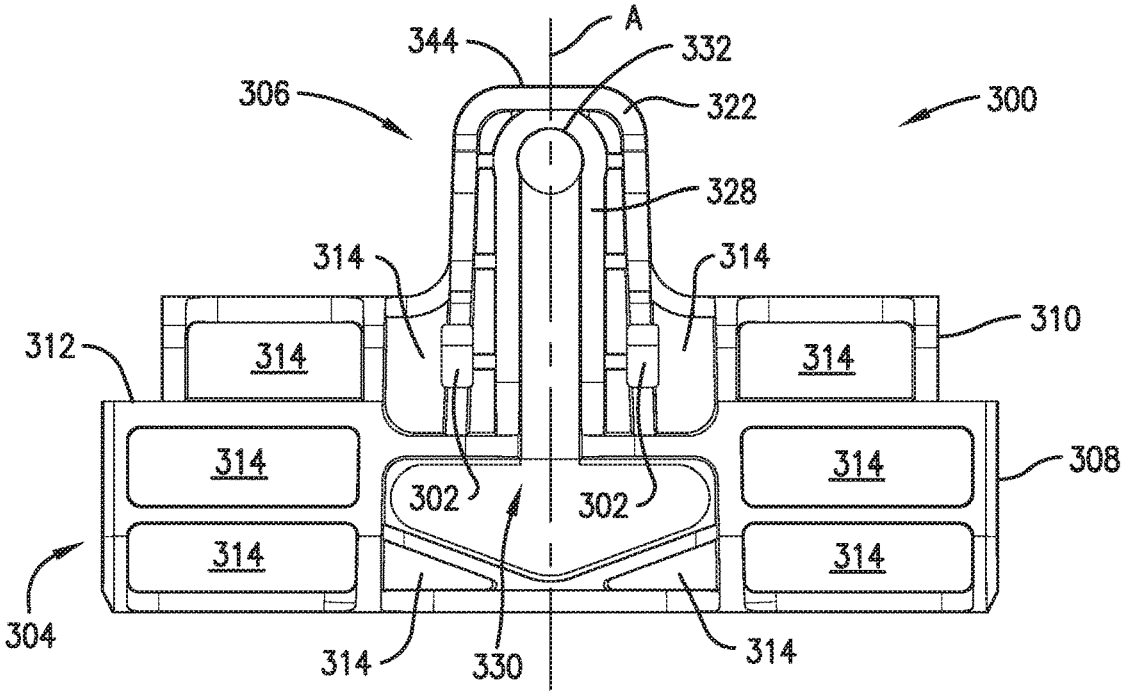
FIG. 7 is a bottom view of the removable lid of FIG. 4.
Figure 8:
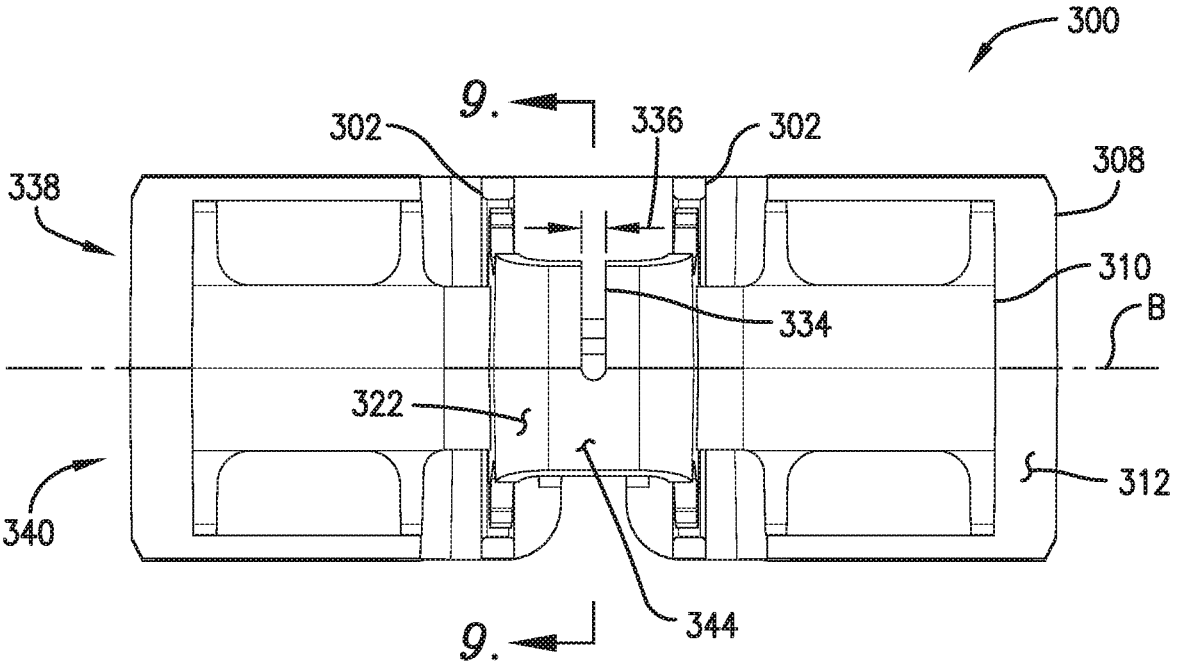
FIG. 8 is a front view of the removable lid of FIG. 4.
Figure 9:
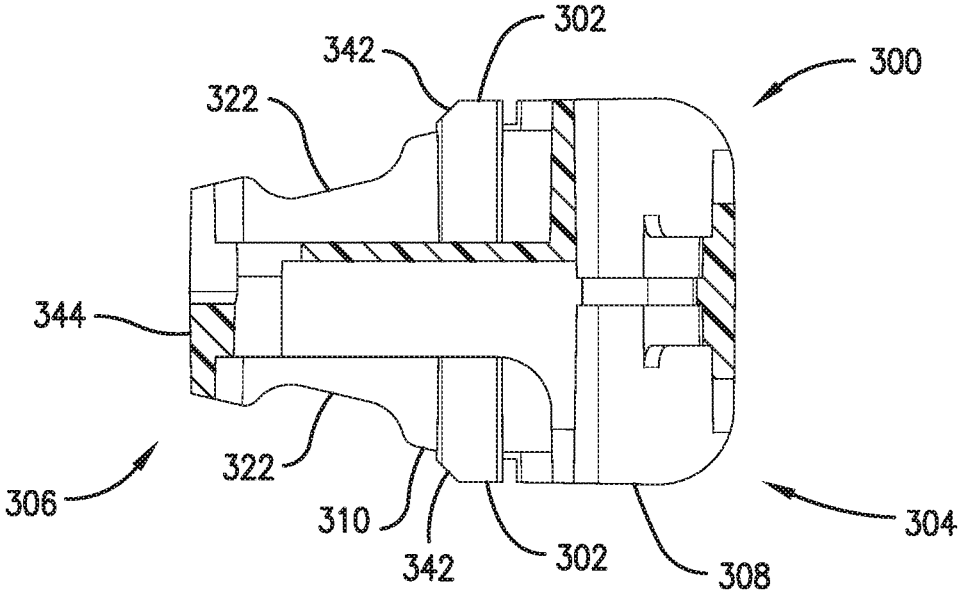
FIG. 9 is a section view of the removable lid of FIG. 4, taken along line 99 shown in FIG. 8.
Figure 13:
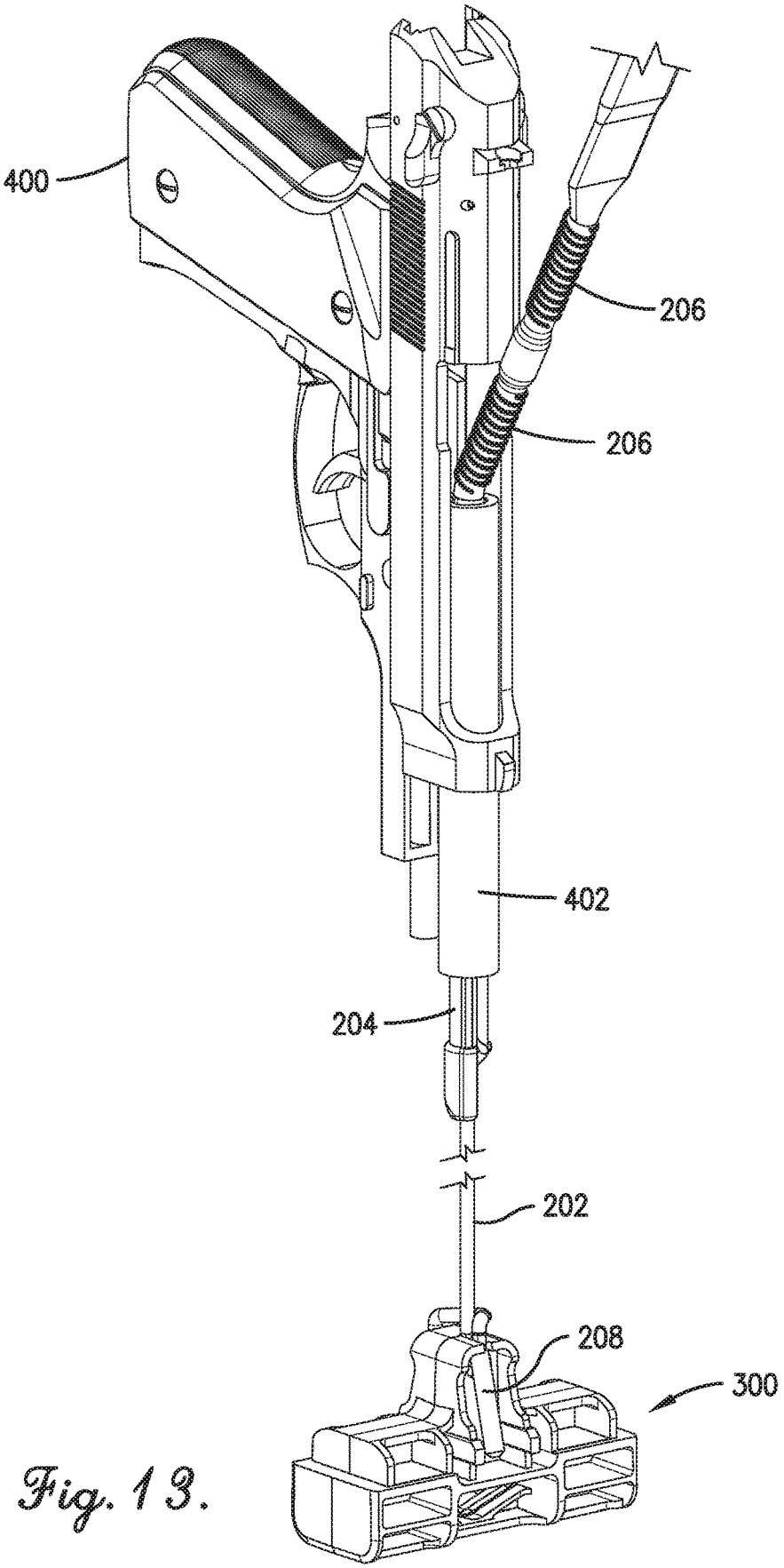
FIG. 13 is an enlarged view of the gun shown in FIG. 10, and with the removable lid of FIG. 4 coupled to the pull cord, and a sheath of the cleaning tool extending through the barrel.

As shown in FIGS. 4-9, the removable lid 300 is generally T-shaped in construction and is sized to close the open top 108 of the container 104 (shown in FIG. 3) in the closed position of FIG. 1, and is configured to serve as a pull handle for the cleaning tool 200 when removed from the enclosure, as shown in FIG. 13. FIG. 4 is a perspective view as seen from the upper right and front sides of the removable lid 300. FIG. 5 is a perspective view as seen from the lower right and front sides of the removable lid 300. FIG. 6 is a top view, FIG. 7 is a bottom view, and FIG. 8 is a front view of the removable lid 300. FIG. 9 is a cross-section view of the removable lid 300 taken along line 9-9 shown in FIG. 8.

As shown in FIG. 6, the removable lid 300 is generally symmetrical with respect to a line A, which, when viewed from the top, is substantially centered on the removable lid 300. In addition, as shown in FIG. 8, the removable lid 300 is generally symmetrical with respect to a line B, which, when viewed from an end, is substantially centered on the removable lid 300. Alternatively, or in addition, the removable lid 300 may include features and/or elements that are not symmetrical with respect to each other.

The removable lid 300 includes a handle section 304 and a connection section 306. In the exemplary embodiment, the handle portion includes an upper section 308, which is external to the container 104 (shown in FIG. 1) when in the closed configuration, and a lower section 310, which is inserted into the interior space 120 (shown in FIG. 3) of the container 104 when in the closed configuration. A shoulder 312 is defined at the intersection of the upper section 308 and the lower section 310. When in the closed configuration, the shoulder 312 is configured to engage a rim 128 (shown in FIG. 3) defined by the open top 108 of the container 104.

In one suitable embodiment, the removable lid 300 may include one or more sealing members (not shown) such as, for example, a gasket, an O-ring, or a sealable foil positioned on or adjacent the shoulder 312 (or the intersection of the upper section 308 and the lower section 310) to provide sealing engagement between the container 104 and the removable lid 300. The sealing members may be fabricated from, for example, without limitation, rubber, plastic, polymeric, synthetic, metallic material, or combinations thereof.

The handle section 304 includes a plurality of cavities 314 defined therein to facilitate the fabrication of the removable lid 300 by a molding process, such as injection molding. The cavities 314 define a plurality of support walls 316 and 318 on the upper and lower sides 338 and 340 of the removable lid 300 as best shown in FIGS. 4-7. As described above, the removable handle is generally symmetric about line B of FIG. 8, and as such the cavities 314 are located opposite a respective cavity 314, thereby defining a center divider 320 therebetween. The center divider 320 and each of the support walls 316 and 318 have substantially the same thickness. This facilitates reducing or eliminating distortion, sink, warp, and inaccurate sizing of the removable lid 300 during cooling after the molding process, as each wall section may cool generally uniformly.

The connection section 306 of the removable lid 300 extends away from the handle section 304, centered generally on line A, shown in FIGS. 6 and 7. The connection section 306 extends through the lower section 310 and intersects the upper section 308 of the handle section 304. The outer edge of the connection section 306 is defined by an outer wall 322. A center wall 324 extends generally transverse between the outer wall 322 and the shoulder 312, defining an upper cavity 326. On the lower side 340 of the center wall 324, the connection section 306 includes an inner support wall 328, which is offset inwardly from the outer wall 322. The inner support wall 328 extends to the shoulder 312. A gap 330 is defined between ends of the inner support wall 328 where it intersects the shoulder 312. This facilitates threading a pull cord of the cleaning tool 200 (shown in FIG. 3) through the connection section 306.

At a distal end of the connection section 306, the center wall 324 includes an aperture 332 defined thererthrough. As shown in FIG. 7, the aperture 332 is generally concentric with the distal end of the inner support wall 328. In the exemplary embodiment, the aperture 332 is substantially circular, although aperture 332 can be any shape that enables the removable lid 300 to function as described herein.

In the exemplary embodiment, the removable lid 300 includes an elongate slot 334 extending through the outer wall 322 of the connection section 306. In particular, the elongate slot 334 is defined in a distal end 344 of the outer wall 322 and extends from the centerline of the removable lid 300 (defined by line B in FIG. 8) through the upper side 338 of the removable lid 300. The elongate slot is open at the top and includes a width 336 configured to enable a pull cord of the cleaning tool 200 (shown in FIG. 3) be selectively positioned therein.

The latch hooks 302 of the removable lid 300 are defined in the outer wall 322 of the connection section 306, as shown in FIGS. 4 and 5. Each end of the latch hooks 302 includes a sloped or chamfered edge 342, where the chamfered edge is defined facing the distal end 344 of the outer wall 322. As such, the chamfered edges 342 facilitate flexing or bowing the front wall 110 (shown in FIG. 2) and the rear wall 112 (shown in FIG. 2) outwardly to engage the latch hooks 302 with the latch apertures 122 (shown in FIG. 2) during closing of the storage case 102.

Figure 10:
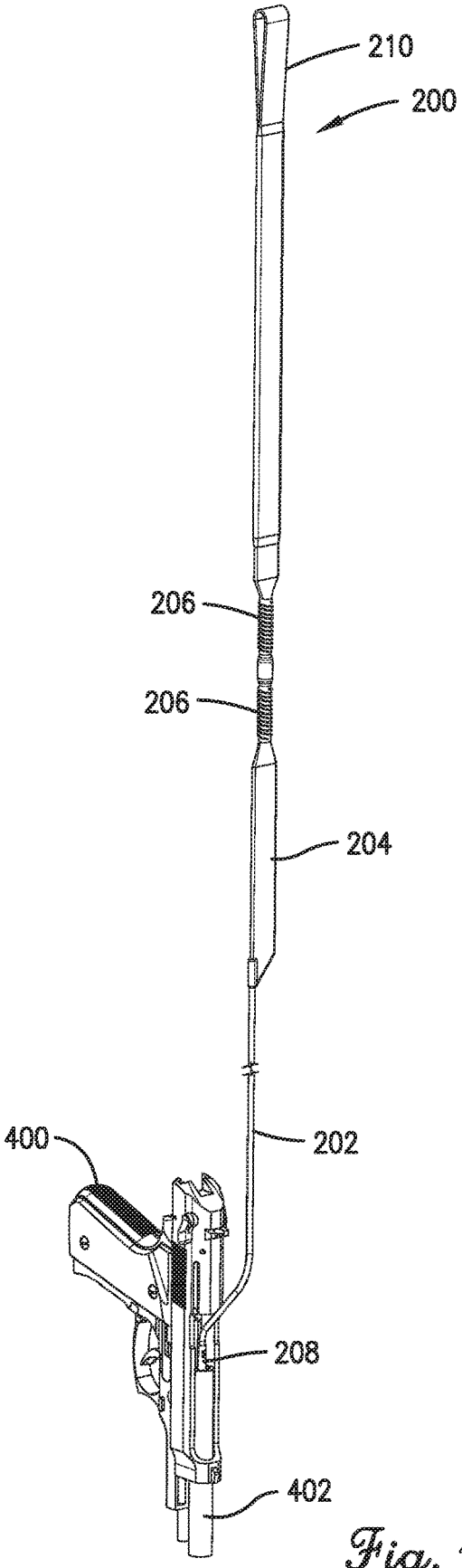
FIG. 10 is a perspective view of the cleaning tool show in FIG. 3, and being used to clean the barrel of an exemplary gun.
Figure 11:
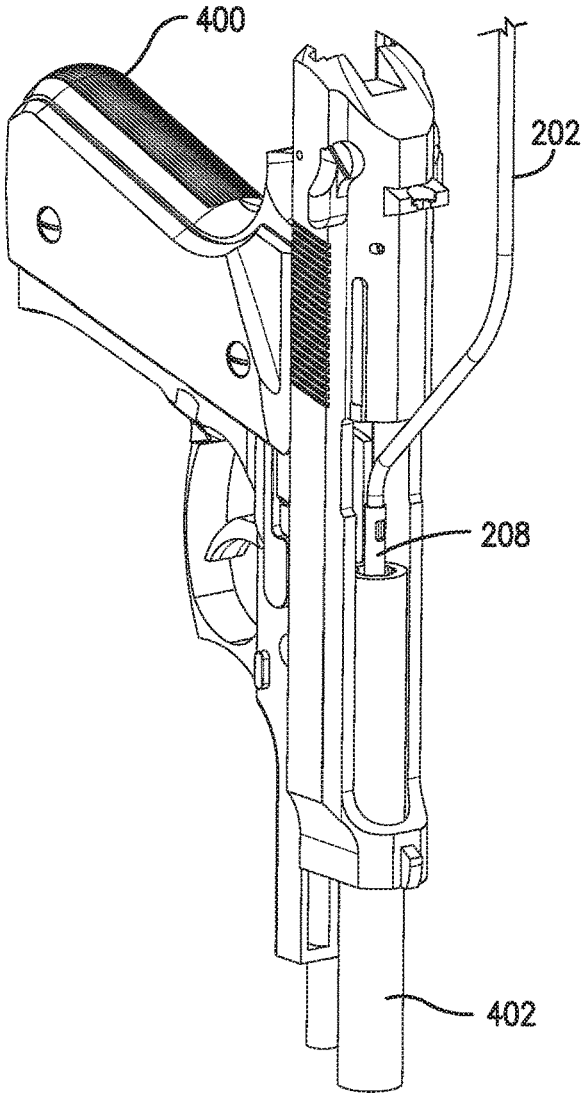
FIG. 11 is an enlarged view of the gun and the cleaning tool shown in FIG. 10, and with the cleaning tool being inserted into the barrel of the gun.
Figure 12:
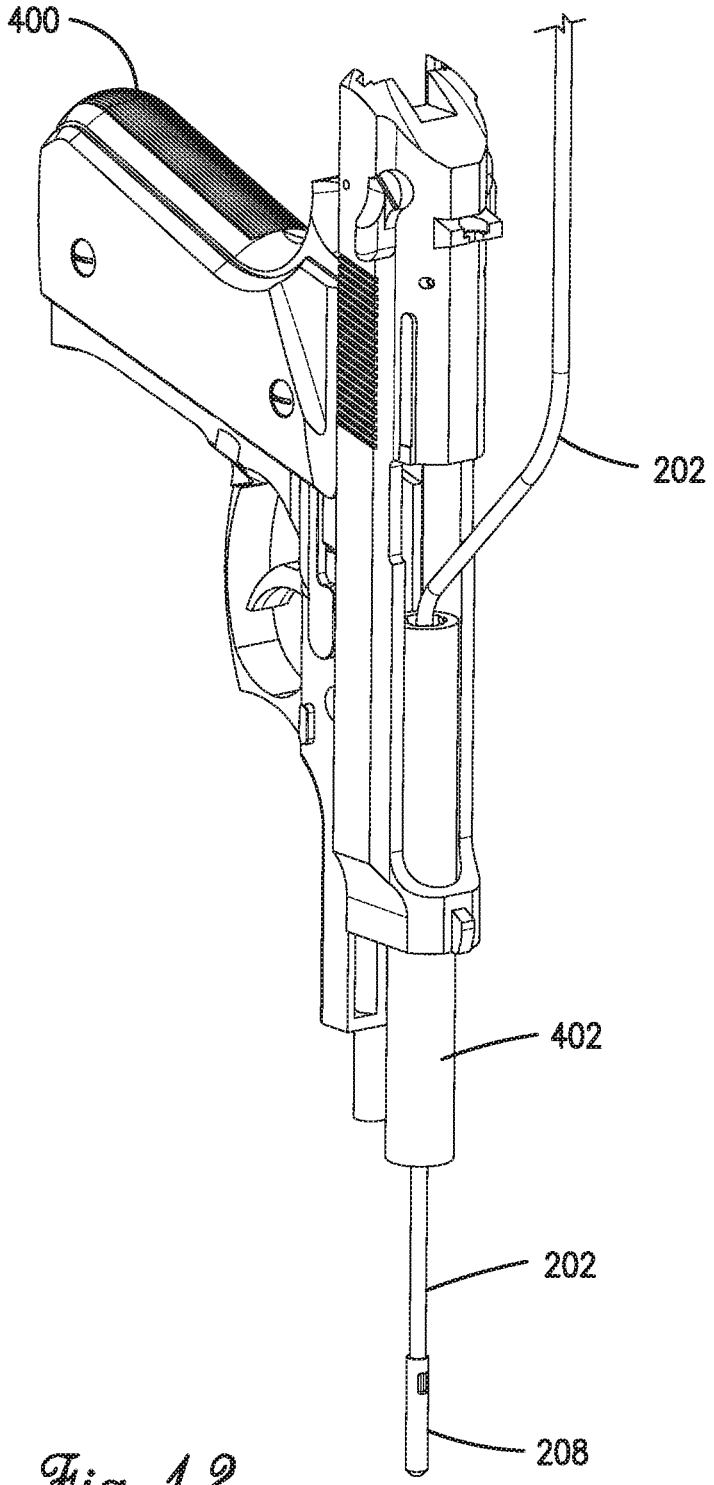
FIG. 12 is an enlarged view of the gun and cleaning tool shown in FIG. 10, and with a pull cord of the cleaning tool extending through the barrel of the gun.
Figure 14:
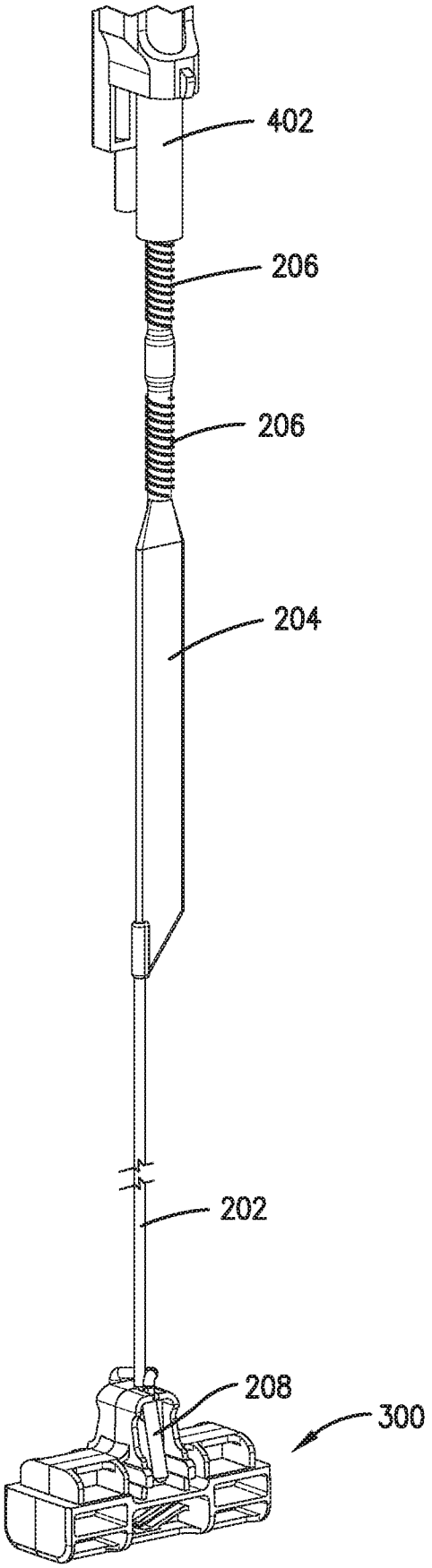
FIG. 14 is an enlarged view of the gun shown in FIG. 10, and with the removable lid of FIG. 4 coupled to the pull cord after a brush of the cleaning tool is pulled through the barrel.

FIGS. 10-14 illustrate the use of the cleaning tool 200 in connection with the removable lid 300. FIG. 10 is a perspective view of the cleaning tool 200 being used to clean the barrel of an exemplary gun 400. FIG. 11 is an enlarged view of the gun 400 and cleaning tool 200 shown in FIG. 10 with the cleaning tool 200 being inserted into the barrel 402 of the gun 400. FIG. 12 is an enlarged view of the gun 400 and cleaning tool 200 shown in FIG. 10 with a pull cord 202 of the cleaning tool 200 extending through the barrel 402 of the gun 400. FIG. 13 is an enlarged view of the gun 400 shown in FIG. 10 with the removable lid 300 coupled to the pull cord 202, and a sheath 204 of the cleaning tool extending through the barrel 402. FIG. 14 is an enlarged view of the gun 400 shown in FIG. 10 with the removable lid 300 coupled to the pull cord 202 after a brush 206 of the cleaning tool is pulled through the barrel 402.

The cleaning tool 200 may be used to clean and/or lubricate tubular devices, such as gun barrel 402. The cleaning tool 200 may include, for example, a gun barrel cleaning device such as the gun barrel cleaning devices of U.S. Pat. No. 5,871,589 (the '589 Patent), U.S. Pat. No. 5,972,125 (the '125 Patent, a continuation of the '589 Patent), and U.S. Pat. No. 6,088,866 (the '866 Patent, a continuation of the '589 Patent), all of which are incorporated by reference herein in their entirety. For example, the cleaning tool 200 may include a pull cord 202, a sheath 204 (broadly, a cleaning section), one or more brushes 206, and a weight 208 coupled to the distal end of the pull cord 202. The pull cord 202 has a proximal end attached to one end of the sheath 204.

In operation, a user may apply a cleaner or solvent to the cleaning tool 200, and particularly to the leading end of a cleaning element (not shown) or sections of the sheath 204, including the brushes 206. The weight 208 is aligned with and inserted or dropped into the breach of the gun 400 or the barrel end of a gun. Slight pressure on the weight 208 or light shaking of the gun 400 or barrel 402 may be required to get the weight 208 to fall or travel the length of the barrel 402 and be retrieved at the other end.

The user pulls on the weight 208 and/or the pull cord 202 through the barrel 402 and laces or threads the pull cord 202 around the removable lid 300, as is described further herein. The user then pulls the removable lid 300 and/or the pull cord 202 to facilitate channeling the sheath 204 into the barrel 402. Further pulling on the removable lid 300 and/or the pull cord 202 channels the brushes 206 into the barrel 402. The brushes 206 scrub and loosen debris from the barrel 402. After the brushes 206, the cleaning element or remaining sections of the sheath 204 enter the barrel. Gun cleaning solvent is squeezed from the cleaning element or sheath 204 and deposited on the inner surface of the barrel 402. Dirt, debris, and other particulates are captured by the sheath 206 as the sheath and/or the cleaning element are pulled through the barrel 402.

If it is determined that there is a large amount of dirt, debris, and residue in the barrel, the user may hold a loop 210 of the cleaning tool 200 and pull the brushes 206 in the reverse direction to provide further scrubbing and cleansing action. The user may pull back and forth on the removable lid 300 and the loop 210 as necessary to facilitate cleaning the barrel 402.

Figure 15:
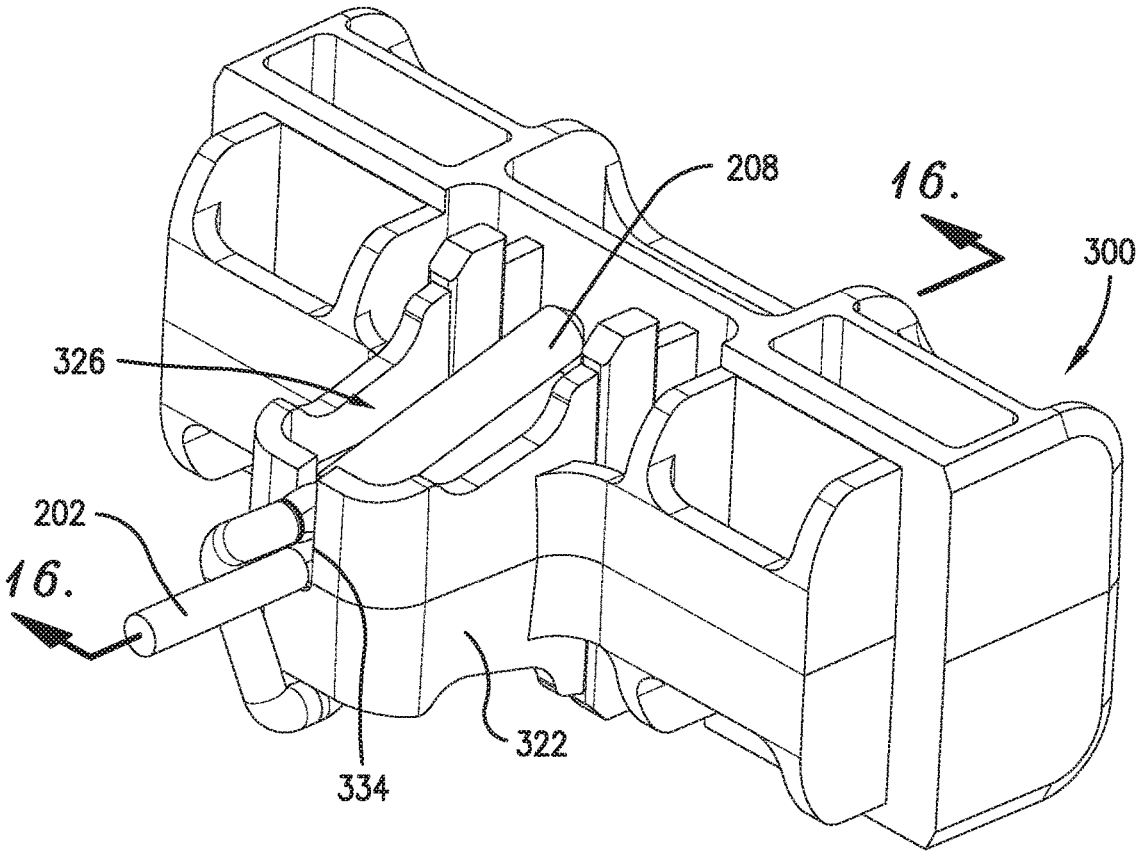
FIG. 15 is a perspective view of the removable lid of FIG. 4 with the distal end of the pull cord threaded thereon.
Figure 16:
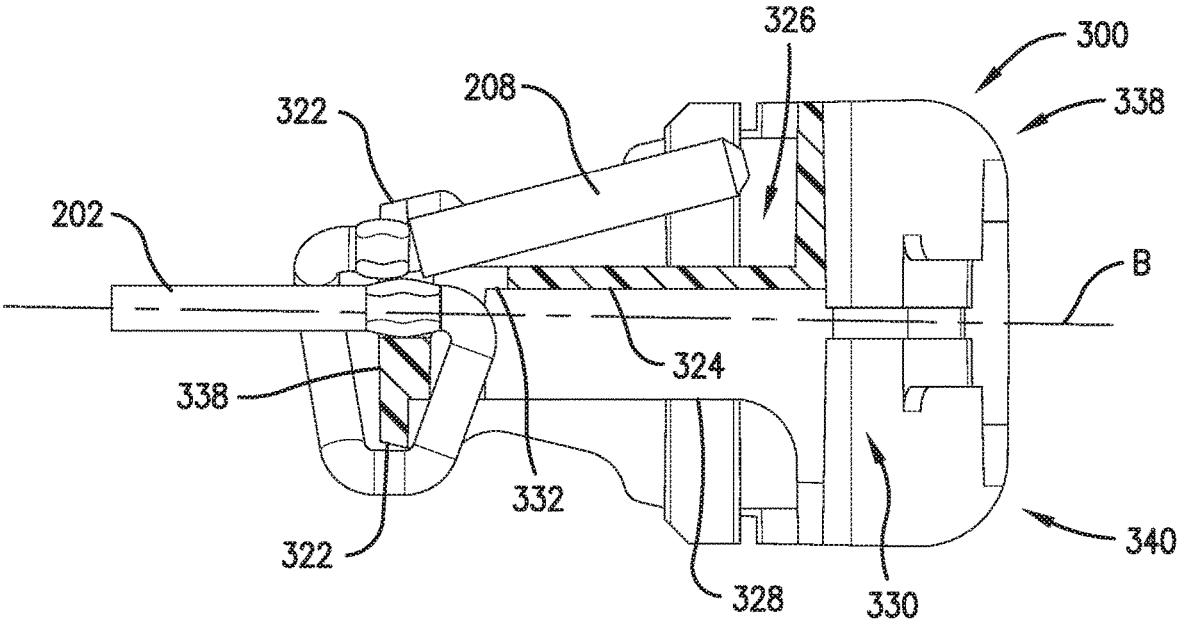
FIG. 16 is a section view of FIG. 15, taken about line 16-16 of FIG. 15.

FIG. 15 is a perspective view of the removable lid 300 with the distal end of the pull cord 202 threaded thereon. FIG. 16 is a section view of FIG. 15, taken about line 16-16. In the exemplary embodiment, the pull cord 202 is threaded or extended through the elongate slot 334, such that a portion of the pull cord 202 extends through the elongate slot 334 and on the lower side 340 of the removable lid 300, i.e., below the center wall 324. The pull cord 202 and the weight 208 may extend through the gap 330 defined between ends of the inner support wall 328 to facilitate threaded the pull cord 202 through the elongate slot 334.

The pull cord 202 is wrapped around the distal end 344 of the outer wall 322 and again threaded or extended through the elongate slot 334. As such, the pull cord 202 overlaps a portion of itself in the elongate slot 334. The weight 208 is sized larger than the width 336 of the elongate slot 334 to prevent the weight 208 from being pulled through the slot. In addition, the weight 208 is positioned in the upper cavity 326, or on the upper side of the center wall 324. In this manner, the user may pull the cleaning tool 200 (shown in FIG. 10) through the barrel 402 (shown in FIG. 2) with the cleaning tool securely coupled thereto.

Embodiments of the gun cleaning apparatus described herein provide a storage case for holding at least one cleaning tool. The storage case includes a removable lid that functions as a pull handle for the cleaning tool stored within the storage case. The removable lid is a T-shaped handle that is selectively latched to the container of the storage case. The removable lid is removed from the container by applying inward pressure to the opposite side walls to bow or flex the front and rear walls outwardly to release the removable lid. The removable lid includes a connection section that enables a pull cord of the cleaning tool to be threaded or selectively coupled thereto. The removable lid can then be used as a pull handle to pull the cleaning tool through a tubular device, such as a gun barrel. After use, the cleaning tool may be uncoupled from the removable lid and stored in the container. The removable lid may be latched to the container to securely retain the cleaning tool within the container. This facilitates containing the dirt, debris, and other particulates removed from the gun barrel by the cleaning tool such that they do not spread to other items or undesirable locations.

Exemplary embodiments of gun cleaning apparatuses having a removable lid that can serve as a pull handle are described above in detail. The apparatuses, systems, and/or methods disclosed are not limited to the specific embodiments described herein, but rather, operations of the methods and components of the systems may be utilized independently and separately from other operations or components described herein. For example, the systems, methods, and/or apparatuses described herein may have other industrial or consumer applications and are not limited to practice with gun barrels as described herein. Rather, one or more embodiments may be implemented and utilized in connection with other industries and/or applications.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A gun cleaning apparatus comprising:

a cleaning tool comprising:

a cleaning section; and a pull cord having a proximal end coupled to said cleaning section and a distal end for pulling said cleaning section through a gun barrel; and a storage case configured to enclose said cleaning tool therein, said storage case comprising a substantially hollow container having an open top, and a removable lid configured to couple to said substantially hollow container, said removable lid selectively positionable between a closed configuration wherein said removable lid closes said open top, and an open configuration wherein said removable lid is removable from said hollow container and serves as a pull handle for said cleaning tool, wherein the removable lid is configured to be removed from the storage case, said removable lid comprising a connection section having an elongated slot defined in the connection section of the removable lid configured for wrapping the pull cord around an outer wall of the connection section to connect said distal end of said pull cord to said connection section, and a handle section for gripping by a user to assist with pulling said cleaning tool through the gun barrel.

2. The gun cleaning apparatus in accordance with claim 1 further comprising a weight coupled to said distal end of said pull cord.

3. The gun cleaning apparatus in accordance with claim 2, wherein said connection section of said removable lid comprises an elongate slot for receiving said distal end of said pull cord and engaging said weight to selectively couple said pull cord to said removable lid.

4. The gun cleaning apparatus in accordance with claim 1, wherein said hollow container further comprises a latch aperture, and wherein said removable lid comprises a latch hook configured to engage said latch aperture when said removable lid is in the closed configuration.

5. The gun cleaning apparatus in accordance with claim 4, wherein a front wall has said latch aperture defined therein, wherein said front wall is configured to bow outward to release said latch hook when inwardly directed pressure is applied to a side wall.

6. The gun cleaning apparatus in accordance with claim 1, wherein said hollow container further comprises an opposite rear wall opposite said front wall, a first side wall and a second side wall extending between said front and rear walls, and a closed bottom, said front and rear walls configured to bow outward when inwardly directed pressure is applied to said first and second side walls.

7. The gun cleaning apparatus in accordance with claim 6, wherein one or more of said front wall and said rear wall comprises a vent defined therein.

8. A storage case for enclosing a cleaning tool having a cleaning section and a pull cord, the pull cord having a proximal end coupled to the cleaning section and a distal end for pulling the cleaning section through a gun barrel, said storage case comprising:

a substantially hollow container having an open top for receiving and storing the cleaning tool therein; and a removable lid configured to couple to said hollow container, said removable lid selectively positionable between a closed configuration wherein said removable lid closes said open top, and an open configuration wherein said removable lid is removable from said hollow container and serves as a pull handle for said cleaning tool, said removable lid comprising a connection section including an elongated slot configured for threading said distal end of said pull cord through said elongated slot after said pull cord has been inserted through the gun barrel, and a handle section for gripping by a user to assist with pulling said cleaning tool through the gun barrel.

9. The storage case in accordance with claim 8, further comprising a weight coupled to said distal end of said pull cord.

10. The storage case in accordance with claim 8, wherein said connection section comprises a center wall and an outer wall extending transversely from a periphery of said center wall and defining a cavity for receiving the distal end of the pull cord.

11. The storage case in accordance with claim 10, wherein said center wall comprises an aperture extending therethrough at a distal end of said connection section.

12. The storage case in accordance with claim 8, wherein said hollow container further comprises a latch aperture, and wherein said removable lid comprises a latch hook configured to engage said latch aperture when said removable lid is in the closed configuration.

13. The storage case in accordance with claim 12, wherein said substantially hollow container has a side wall, and a front wall with said latch aperture defined therein, and wherein said front wall is configured to bow outward to release said latch hook when inwardly directed pressure is applied to said side wall.

14. The storage case in accordance with claim 8, wherein said hollow container further comprises, an opposite rear wall opposite said front wall, a first side wall and a second side wall extending between said front and rear walls, and a closed bottom, said front and rear walls configured to bow outward when inwardly directed pressure is applied to said first and second side walls.

15. The storage case in accordance with claim 14, wherein one or more of said front wall and said rear wall comprises a vent defined therein.

16. The storage case in accordance with claim 8, wherein said handle section of said removable lid comprises an upper section and a lower section coupled to said upper section and defining a shoulder at an intersection of said upper and lower sections.

17. The storage case in accordance with claim 16, wherein in the closed configuration, said shoulder engages said rim of said hollow container.

18. A method of cleaning a gun barrel using a gun cleaning apparatus, the gun cleaning apparatus including a storage case and a cleaning tool, said method comprising:

removing a removable lid from the storage case, the removable lid including a connection section for connecting to the cleaning tool after the cleaning tool has been inserted through the gun barrel, and a handle section for gripping by a user to assist with pulling the cleaning tool through the gun barrel;

coupling the cleaning tool to the connection section of the removable lid, wherein coupling the cleaning tool to the connection section of the removable lid comprises threading a pull cord of the cleaning tool through an elongated slot defined in the connection section of the removable lid, wrapping the pull cord around an outer wall of the connection section; and threading a distal end of a pull cord of the cleaning tool back through the elongated slot; and pulling on the handle section of the removable lid to channel the cleaning tool through the gun barrel.

19. The method in accordance with claim 18, wherein removing the removable lid from the storage case comprises applying an inwardly directed pressure to a side wall of a substantially hollow container of the storage case, wherein the substantially hollow container includes a front wall configured to bow outward to release the removable lid in response to the inwardly directed pressure.

20. The method in accordance with claim 18, wherein threading the distal end of a pull cord of the cleaning tool back through the elongated slot involved overlapping a portion of the pull cord positioned in the elongated slot.

* * * * *